US006487984B1

(12) United States Patent
Pape et al.

(10) Patent No.: US 6,487,984 B1
(45) Date of Patent: Dec. 3, 2002

(54) PORTABLE BOAT CLEAT

(76) Inventors: Robert Kenneth Pape, 2672 Gulfstream La., Fort Lauderdale, FL (US) 33312; Karen Thieme-Pape, 2672 Gulfstream La., Fort Lauderdale, FL (US) 33312

( * ) Notice: Subject to any disclaimer, the term of this patent is extended or adjusted under 35 U.S.C. 154(b) by 0 days.

(21) Appl. No.: 09/858,164

(22) Filed: May 15, 2001

(51) Int. Cl.[7] ..... B63B 21/04
(52) U.S. Cl. ..... 114/218
(58) Field of Search ..... 114/218

(56) References Cited

U.S. PATENT DOCUMENTS 4,354,445 A * 10/1982 Kafka et al. ..... 114/218
6,234,101 B1 * 5/2001 Czipri ..... 114/218

* cited by examiner

*Primary Examiner*—Jesus D. Sotelo
(74) *Attorney, Agent, or Firm*—Glenn E. Gold; H. John Rizvi; Gold & Rizvi, P.A.

(57) ABSTRACT

A portable boat cleat assembly (10) includes a cleat member (12) mounted to an upper surface (16) of a base member (14) and a cylindrical rod member (20) having an upper end (22) attached to the lower surface (18) of the base member, wherein the cylindrical rod member is sized and shaped for being snugly received within a rod-receiving cylinder (36) extending generally downward through an upper hull portion (30) into an interior hull space of a boat.

8 Claims, 4 Drawing Sheets

PORTABLE BOAT CLEAT

BACKGROUND OF THE INVENTION

1. Field of Invention

The invention relates generally to boating equipment, and more particularly to a portable boat cleat.

2. Description of the Prior Art

In many boating situations it is necessary to secure or tie a line, rope, or other attachment means to a boat cleat. For instance, cleat lines are typically required to tether a boat to a dock or other fixed structure. In other situations, cleat lines are used to tie off a smaller craft (such as a dingy), or to hang cushions, fenders, bait and chum baskets, and other accessories over the side of the boat.

Ordinarily, boats and other vessels are constructed having one or more cleats permanently attached to an upper surface of the boat hull, such as along the gunwale, using mechanical fasteners, adhesives and the like. Still, boaters oftentimes find themselves in situations where it would be desirable to have one or more additional cleats along the gunwale, and particularly toward the stern. One potential solution would be to permanently install additional boat cleats. However, for various reasons, this is not a desirable approach. Instead, it would be more desirable to provide a boat cleat apparatus adapted for being temporarily attached to an existing structure along the hull gunwale.

Accordingly, there is an established need in the boating industry for a portable boat cleat apparatus adapted to be quickly and effectively secured to an existing hull structure to provide additional line attachment locations.

SUMMARY OF THE INVENTION

It is an object of the present invention to provide a portable boat cleat apparatus having means for being releasably secured to an existing boat hull structure.

It is another object of the present invention to provide a portable boat cleat assembly having a downwardly extending rod member sized and shaped for being snugly received within a fishing rod holder permanently secured to the gunwale portion of a boat hull.

It is a yet another object of the present invention to provide a portable boat cleat apparatus adapted to be temporarily secured within such a holder without the use of permanent-type attachment means such as mechanical fasteners, adhesives and the like.

It is a further object of the present invention to provide such a portable boat cleat apparatus having an adjustable length rod member assembly.

In a preferred embodiment of the invention a portable boat cleat assembly comprises: a base member having upper and lower surfaces; a cleat member secured to the upper surface of the base member; and a cylindrical rod member having an upper end attached to the lower surface of the base member, wherein the rod member is sized and shaped for being snugly received within a rod-receiving cylinder extending generally downward into an interior hull space of a boat.

In another aspect of the invention the cylindrical rod member is provided at its lower end with means for releasably attaching to an anchoring structure provided within the rod-receiving cylinder. In one embodiment according to this aspect of the invention, a pair of inverted L-shaped cutout sections provided at the lower end of the cylindrical rod member are adapted for being temporarily secured to a horizontal cross member within the rod-receiving cylinder upon insertion of the rod member therein and subsequent application of a twisting motion to the cleat member.

In a further aspect of the invention, the portable boat cleat is provided having a length-adjustable cylindrical rod assembly, comprising: a cylindrical rod-extension member having a plurality of vertically spaced-apart apertures; and a locking means attached to the main cylindrical rod member and adapted for selectively engaging the apertures in the extension member.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF PREFERRED EMBODIMENTS

Figure 1:
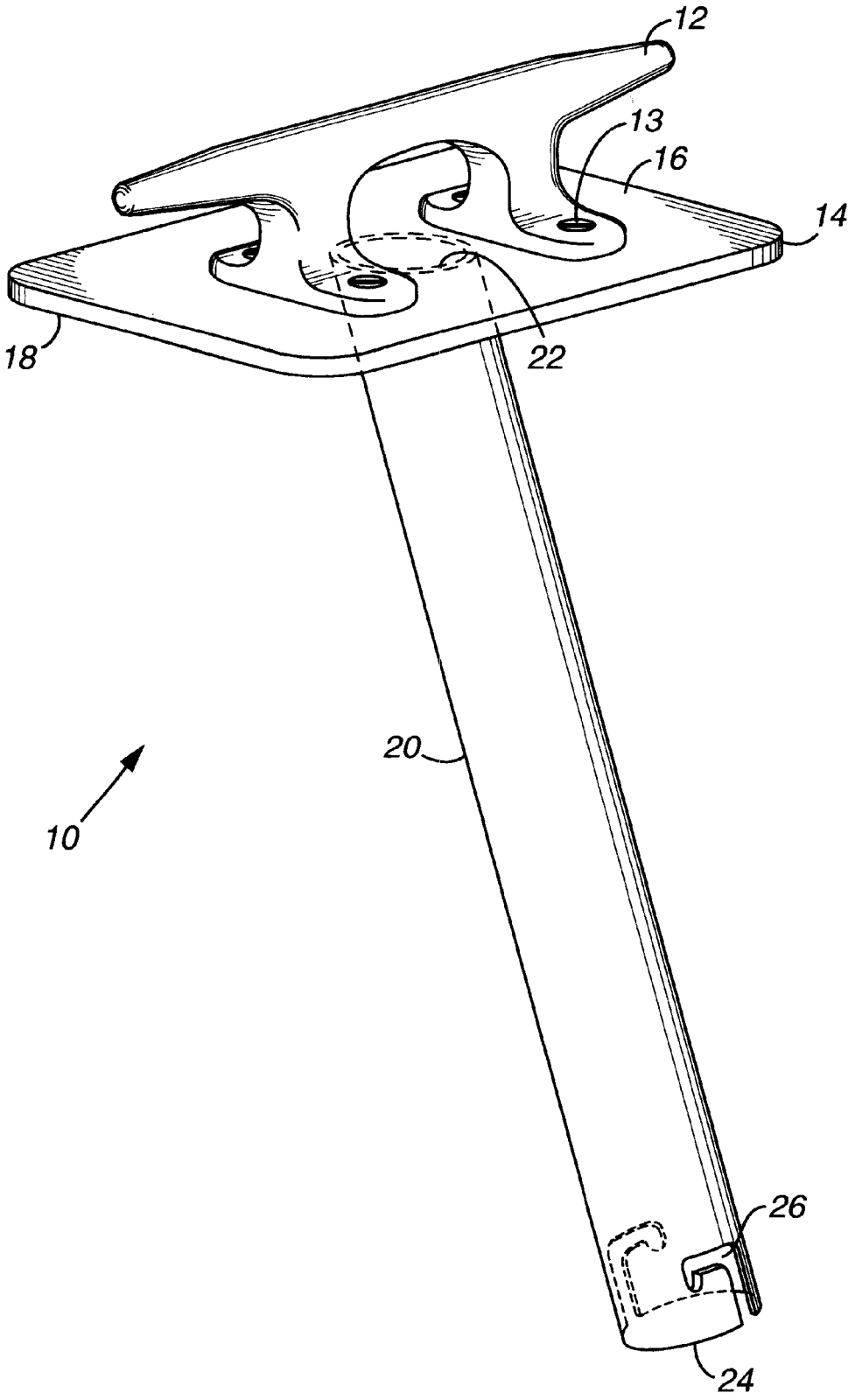
FIG. 1 is a perspective view of a portable boat cleat assembly accordance with a preferred embodiment of the present invention.

Referring now to FIG. 1, in a preferred embodiment of the present invention a boat cleat assembly, shown generally as reference numeral 10, includes a base plate 14 having a cleat member 12 attached by conventional fasteners 13 to its upper surface 16. A cylindrical rod member 20 has an upper end 22 permanently attached to the lower surface 18 of base plate 14. Preferably the upper end 22 of rod member 20 is welded to the base plate 14. Preferably, the cleat 12, base plate 14, and rod member 20 are all fabricated from a rigid metal such as stainless steel.

Figure 2:
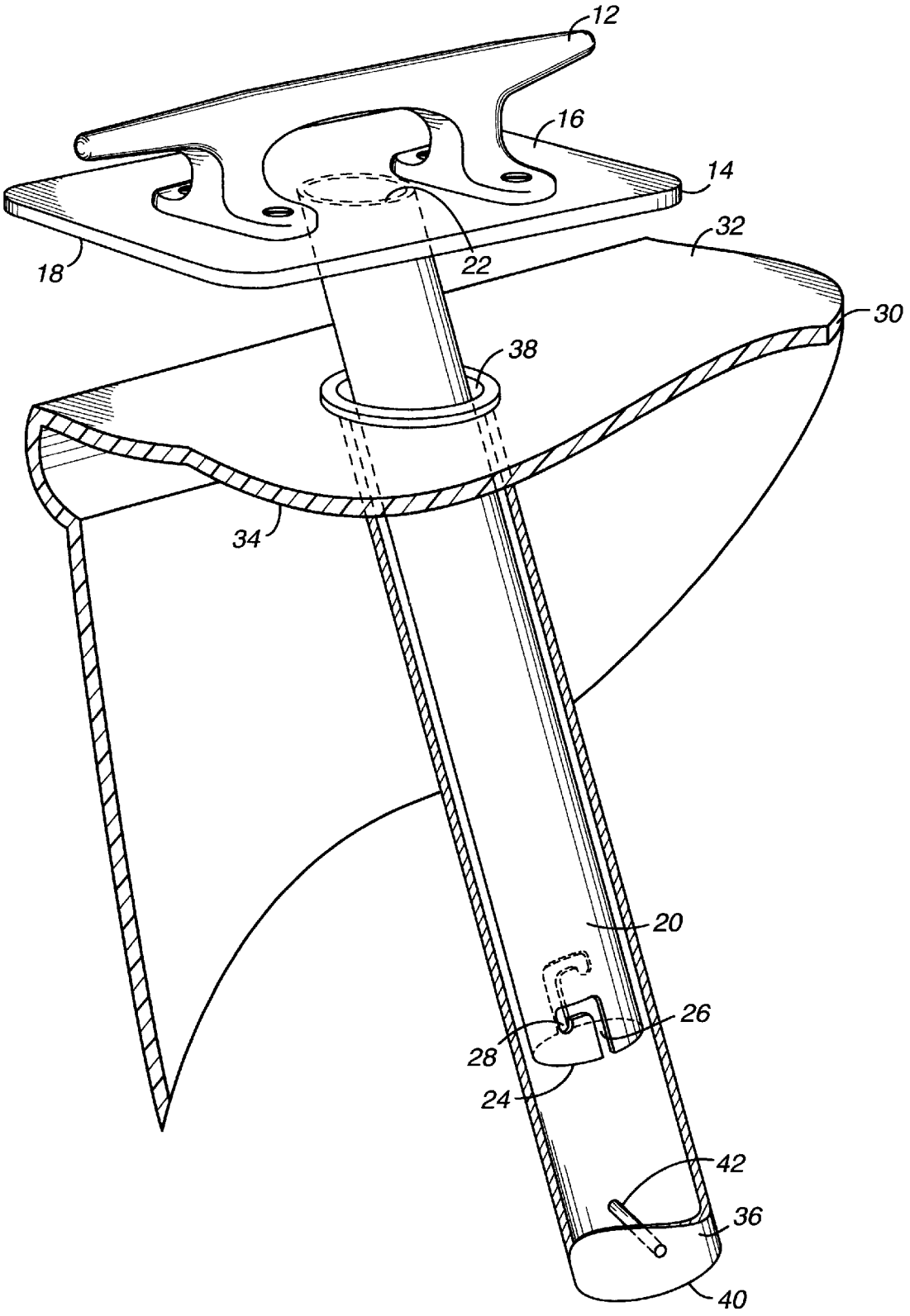
FIG. 2 is a perspective view of the portable boat cleat of FIG. 1 shown partially inserted within a rod-receiving cylinder 36 extending into the boat hull 30.
Figure 3:
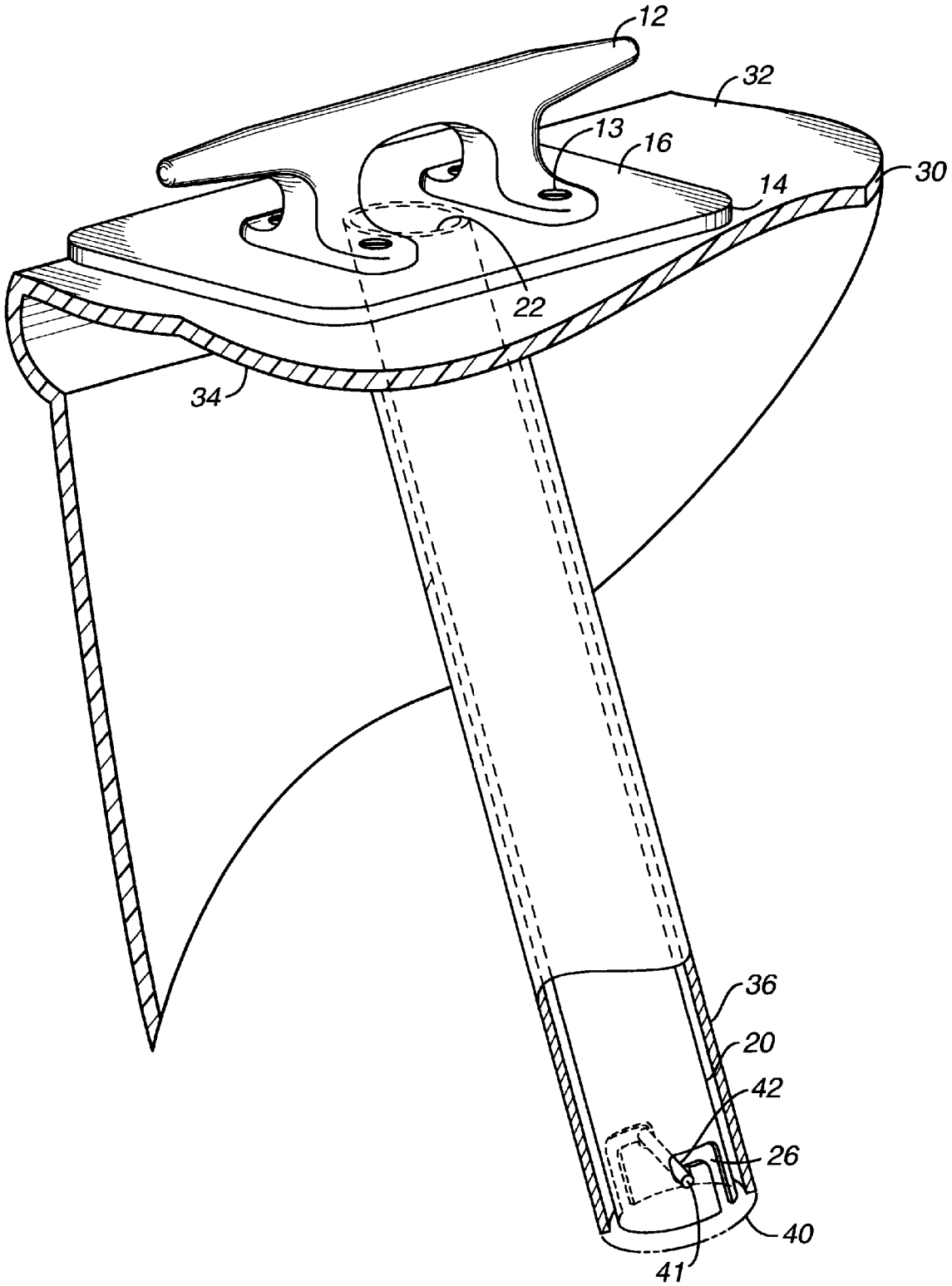
FIG. 3 is a perspective view of the portable boat cleat of FIG. 1 fully inserted within and secured to the rod-receiving cylinder.

Referring now to FIGS. 1–3, the portable cleat assembly 10 is designed for sliding engagement within a cylindrical rod-receiving member 36 extending vertically downward through an upper hull side 30. For example, cylindrical rod-receiving member 36 can comprise a conventional fishing rod holder. Most boats are manufactured having one or more fishing rod holders extending through the gunwale and permanently fastened thereto proximate the stern. Although cylindrical rod member 20 is illustrated attached at an acute angle to the lower surface 18 of base plate 14, it will be apparent to those skilled in the art of boating that the rod member can be attached perpendicular to the base plate. The particular angle is primarily dictated by the angle of the rod-receiving member 36. In the most basic embodiment of the invention, cylindrical rod member 20 is sized and shaped for being snugly received within rod holder 36 such that additional means for securing the cleat assembly are not necessary.

However, lower end 24 of cylindrical rod member 20 is preferably provided with means for temporarily securing the rod member to the rod-receiving member 36 to prevent the cleat assembly 10 from becoming inadvertently disengaged therefrom. For instance, lower end 24 of cylindrical rod member 20 can be provided with inverted L-shaped cutouts 26 adapted for engaging a horizontal cross-member 42 fixed at opposite ends 41 to the interior surface of rod-receiving member 36. In use, rod member 20 is initially inserted into rod-receiving member 36 with the vertical portions of the L-cutouts 26 aligned over the cross member 42. Subsequently, the entire cleat assembly 10 is rotated (in this case, in a counter-clockwise direction) until the cross-member 42 engages depressed portions 28 (shown in FIG. 2) of L-shaped cutouts 26. In this manner, the mere frictional engagement between the outer surface of the cross-member 42 and the depressions 28 prevent movement of the cleat assembly 10 when acted upon by an upward force, such as the pull of a line attached to cleat member 12 during use.

Figures 4, 5:
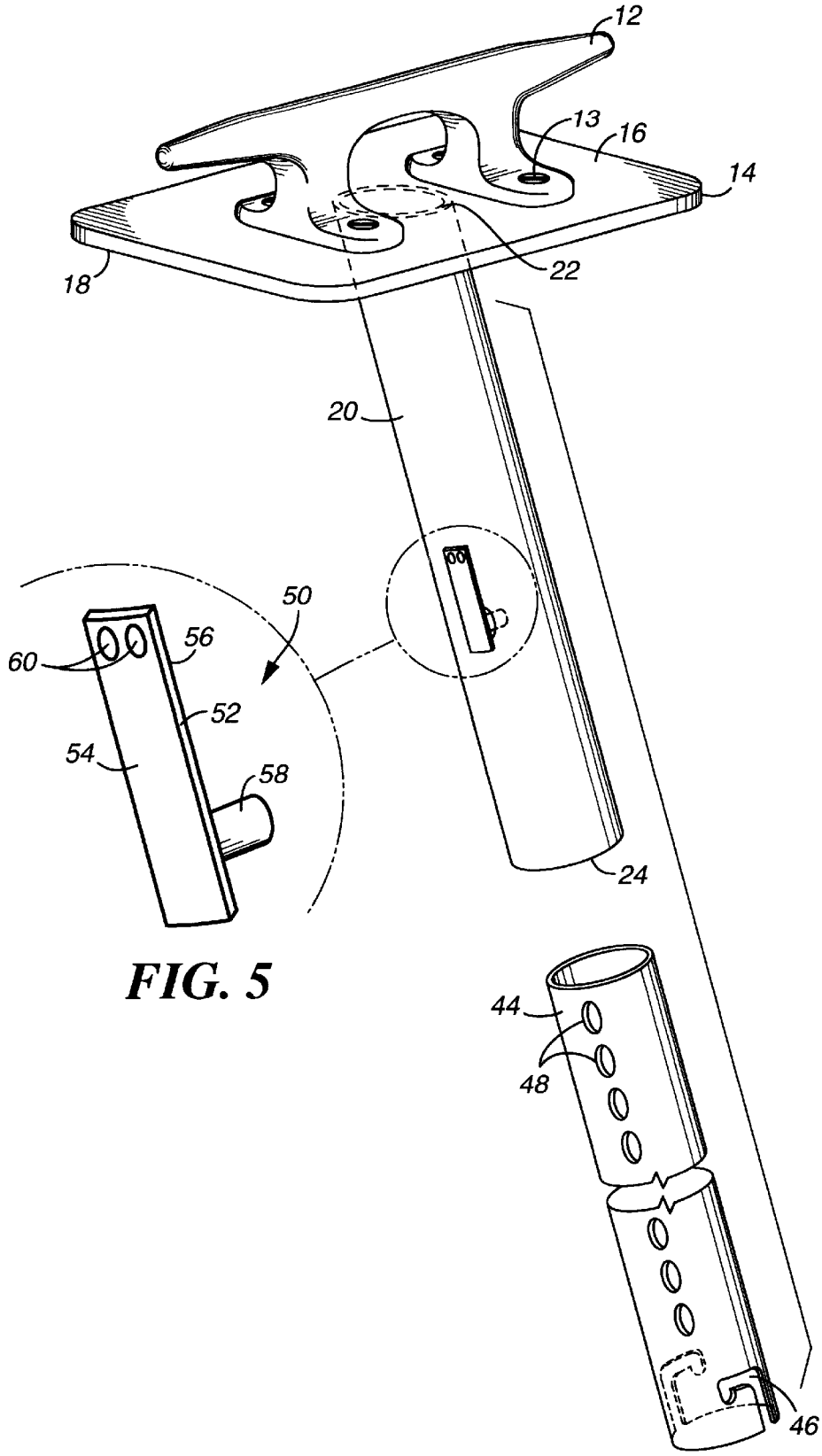
FIG. 4 is a partially exploded perspective view of a portable boat, cleat assembly having a length-adjustable cylindrical rod structure in accordance with an alternate embodiment of the present invention.
FIG. 5 is a magnified view of the locking mechanism 50 in FIG. 4.

Referring now to FIGS. 4 and 5, in an alternate embodiment of the present invention, a portable cleat assembly is provided having a length-adjustable cylindrical rod structure. In particular, a cylindrical rod extension member 44 is provided having an outer diameter slightly less than the inner diameter of main cylindrical rod member 20. In this manner, the rod extension member 44 can be snugly inserted within the main rod member 20 through its lower end 24. Main rod member 20 is provided with a locking mechanism, shown generally as reference numeral 50, for selectively engaging vertically-spaced apertures 48 in extension member 44.

Preferably, locking mechanism 50 is comprised of a thin arcuate tab member 52 having outer and inner surfaces, 54 and 56, respectively, and a nub 58 depending inwardly from inner tab surface 56. The nub 58 is sized and shaped for being snugly received through extension member apertures 48. Preferably, tab member 52 is provided permanently fastened to the outer surface of cylindrical rod member 20, for example, by one or more rivets 60. The thickness of tab member 52 can vary depending upon the tab material used. However, the thickness should be controlled to enable the tab member to be manually flexed outwardly, for example, using a fingernail.

In use, the tab member 52 is outwardly displaced while the extension rod member 44 is slidably inserted within main rod member 20. When the overall rod length is achieved, tab member 52 is released so that nub 58 engages corresponding aperture 48. When the assembly is then inserted within cylindrical rod-receiving member 36 (not shown in FIGS. 4 and 5), the interior surface of rod-receiving member 36 prevents the outward displacement of the tab 52, ensuring a locking engagement between main rod member 20 and rod extension member 44.

While the preferred embodiments of the invention have been illustrated and described, it will be clear that the invention is not limited to these embodiments only. Numerous modifications, changes, variations, substitutions and equivalents will be apparent to those skilled in the art without departing from the spirit and scope of the invention as described in the claims. For example, although the assembly is depicted having a conventional cleat structure, other fastening structures could be employed, including, but not limited to, C-cleats, cam cleats, fairlead-type cleats and padeye-type cleats. Furthermore, alternative types of attachment means could be employed for anchoring the cylindrical rod member 20 to the cylindrical rod-receiving member 36, depending upon the structure of member 36.

What is claimed is:

1. A portable boat cleat assembly, comprising:

a base member having upper and lower surfaces;

a cleat member secured to the upper surface of said base member; and a cylindrical rod member having upper and lower ends, the upper end of said rod member attached to the lower surface of said base member and the lower end of said rod member having attachment means, wherein the rod member is sized and shaped for being snugly received within a rod-receiving cylinder extending generally downward into an interior hull space of a boat, the rod-receiving cylinder having an anchoring structure to which the rod member attachment means can be releasably secured.

2. A portable boat cleat assembly as recited in claim 1, wherein the anchoring structure comprises a horizontal cross member extending across the interior of the rod-receiving cylinder, said attachment means further comprising a pair of inverted L-shaped cutouts provided at the lower end of said cylindrical rod member.

3. A portable boat cleat assembly, comprising:

a base member having upper and lower surfaces;

a cleat member secured to the upper surface of said base member; and a cylindrical rod member having upper and lower ends, the upper end of said rod member welded to the lower surface of said base member, wherein the rod member is sized and shaped for being snugly received within a rod-receiving cylinder extending generally downward into an interior hull space of a boat.

4. A portable boat cleat assembly, comprising:

a base member having upper and lower surfaces;

a cleat member secured to the upper surface of said base member; and a cylindrical rod member having upper and lower ends, the upper end of said rod member secured to the lower surface of said base member such that the central axis of said cylindrical rod member forms an acute angle with the lower surface of said base member, wherein the rod member is sized and shaped for being snugly received within a rod-receiving cylinder extending generally downward into an interior hull space of a boat.

5. A portable boat cleat assembly as recited in claim 4, wherein said acute angle is within the range of about 5 degrees to 45 degrees.

6. A portable boat cleat assembly as recited in claim 5, wherein said acute angle is approximately 30 degrees.

7. A portable boat cleat assembly, comprising:

a base member having upper and lower surfaces;

a cleat member secured to the upper surface of said base member;

a cylindrical rod member having an opening extending therethrough, and upper and lower ends, the upper end of said rod member secured to the lower surface of said base member;

a cylindrical rod extension member having a plurality of vertically spaced-apart apertures provided therein; and a locking means attached to said cylindrical rod member and adapted for selectively engaging the apertures in said cylindrical rod extension member.

8. A portable boat cleat assembly as recited in claim 7, wherein said locking means further comprises:

a thin arcuate member having an upper end, a lower end, an inner surface and an outer surface, the upper end attached to the outer surface of said cylindrical rod member; and a nub extending inwardly from the inner surface of said arcuate member through the opening in said cylindrical rod member, the nub sized and shaped for being snugly received through the apertures in said cylindrical rod extension member;

said arcuate member attached at its upper end to said cylindrical rod member.

* * * * *